United States Patent [19]

White

[11] Patent Number: 4,542,666

[45] Date of Patent: Sep. 24, 1985

[54] ANGLE STOP VALVE WRENCH

[76] Inventor: Don H. White, 2873 W. Keys La., Anaheim, Calif. 92804

[21] Appl. No.: 528,592

[22] Filed: Sep. 1, 1983

[51] Int. Cl.[4] ..... B25B 13/00

[52] U.S. Cl. ..... 81/176.1; 81/119; 81/177 D; 81/177.5

[58] Field of Search ..... 81/90 R, 90 B, 90 D, 81/90 E, 90 F, 119–121, 177 D, 177 R, 58.1, 64; 145/61 L, 65

[56] References Cited

U.S. PATENT DOCUMENTS

| | | | |
|---|---|---|---|
| 887,643 | 5/1908 | Jackson | 81/121 R |
| 1,560,254 | 11/1925 | Jackson | 81/121 R |
| 2,405,462 | 8/1946 | Stair | 81/121 X |
| 2,464,941 | 3/1949 | Rader | 81/90 R X |
| 3,213,720 | 10/1965 | Wallis et al. | 81/90 |
| 3,635,106 | 1/1972 | Homs | 81/121 R |
| 3,678,789 | 7/1972 | Wilson | 81/64 |
| 4,048,875 | 9/1977 | Heinen et al. | 81/121 R X |
| 4,125,913 | 11/1978 | Lewis | 81/121 R X |
| 4,334,443 | 6/1982 | Pearson | 81/90 R |

*Primary Examiner*—Frederick R. Schmidt
*Assistant Examiner*—Debra S. Meislin
*Attorney, Agent, or Firm*—William L. Chapin

[57] ABSTRACT

A wrench for turning oval handles of the type used in angle stop valves comprises a flat base plate with a truncated oval cross-section box extending downward from the base plate. A metal post extending upward from the center of the base plate has a polygonal cross section upper end engageable by a standard wrench handle. Opposed parallel tabs extending upwards from either side of the base plate have holes through which a bar with a grooved end may be inserted and butted up against the base of the post, providing additional means for applying torque to the axis of the wrench.

11 Claims, 6 Drawing Figures

FIG. 1
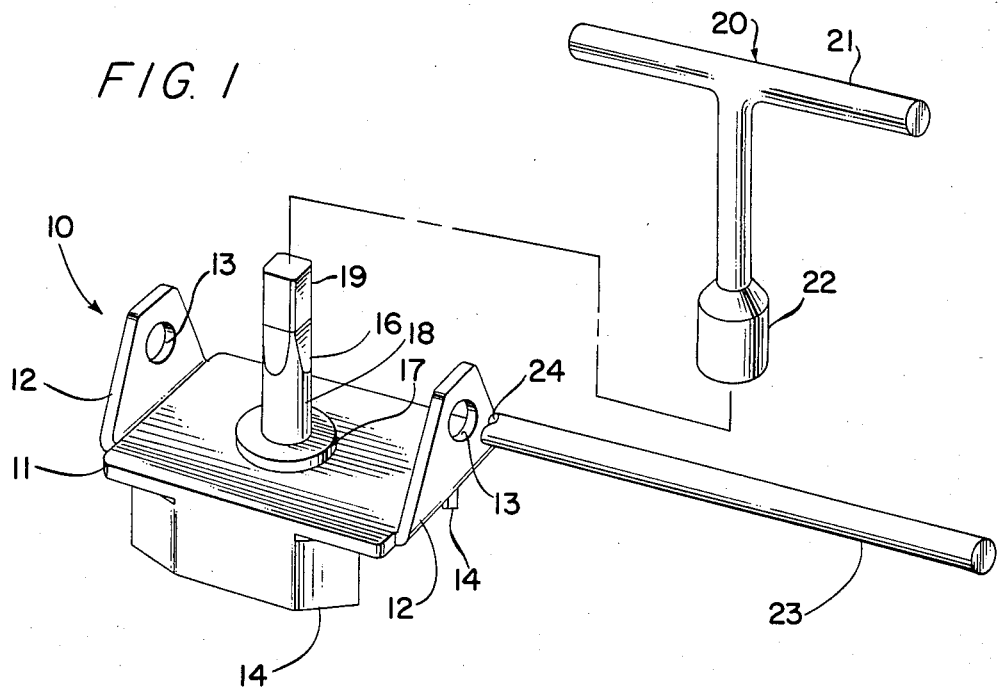
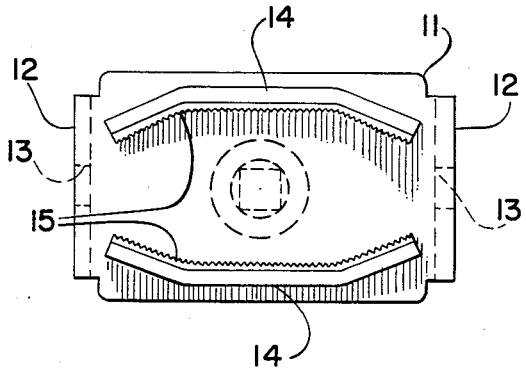
FIG. 2
FIG. 3
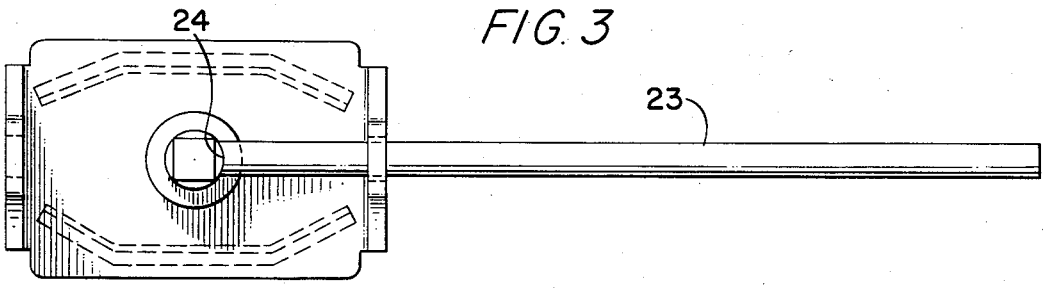

ANGLE STOP VALVE WRENCH

BACKGROUND OF THE INVENTION

A. Field of the Invention

The present invention relates to wrenches for turning valve handles and more particularly to that class of wrenches suited to turning oval valve handles. Valves having inlet and outlet pipes disposed at right angles and having oval handles are commonly used in household plumbing systems as shut-off valves in the water supply lines to sinks and toilets. Such valves are commonly referred to as angle stop valves.

Oftentimes, angle stop valves remain in fixed open positions for long periods of time until sink faucets or other parts of the plumbing system downstream from the angle stop valve require maintenance. As a result of being in one position for long periods of time, angle stop valve handles often require more torque to turn them than can be applied by hand. As a result, the homeowner or professional plumber servicing the plumbing system frequently is required to resort to makeshift methods of freeing a stuck angle stop valve. This often results in damaged or broken valve handles and frayed tempers. The present invention was conceived of in an effort to alleviate the aforementioned difficulties caused by stubborn or stuck angle stop valves.

B. Description of the Prior Art

Jackson, U.S. Pat. No. 1,560,254, Nov. 3, 1925, discloses a wrench for turning the drain cock of an automobile engine, combined with a funnel-shaped cup for receiving drain oil. The wrench has an elongated handle slidably and rotatably mounted in a horizontally disposed tube formed from a bail strip mounted to the upper, wider end of the cup. The end of the wrench nearest the cup has a socket formed of flanges 3 and 4 which form a recess in the general shape of a drain cock head.

Rader, U.S. Pat. No. 2,464,941, Mar. 22, 1948, discloses a C-clamp wrench having a socket formed by downwardly projecting flanges 3 and 4.

Wallis, U.S. Pat. No. 3,213,720, Oct. 26, 1965, discloses a key for freeing jammed garbage disposers. The key has a longitudinal channel tube section 18 adapted to fitting over impeller lugs 14 of the disposer to permit torque to be applied to lugs 14 through handle 24 of the key.

Homs, U.S. Pat. No. 3,635,106, Jan. 18, 1972, discloses a wrench for turning sprinkler valve heads. The end of the wrench opposite the handle has a socket whose interior has the shape of a hollow Greek cross complimentary to the shape of a conventional valve handle.

Heinen, U.S. Pat. No. 4,048,875, Sept. 20, 1977, discloses a wrench for tightening nuts onto reinforcing or anchoring rods having spiral threads which extend around only a portion of the circumference of the rod. The wrench head has the shape of an elongated tubular sleeve, and has transverse slots 15 near the upper end of the sleeve. The slots are adapted to receiving a forked key 16 which forcibly engages the rod, permitting rod and nut to be turned together when the key is in place, and the nut only when the key is removed.

Lewis, U.S. Pat. No. 4,125,913, Nov. 21, 1978, discloses a multipurpose tube wrench having a tubular body. A hole 4 passing transversely through the center section of the tubular wrench body accomodates a rod-shaped cylindrical member which permits a substantial torque to be applied around the axis of the tube.

BRIEF SUMMARY OF THE INVENTION

The present invention comprehends a wrench adapted for use on valves having an oval handle. The invention comprises a flat metal base plate having opposed antisymmetric flanges which extend perpendicularly downward from the base plate. The flanges define a truncated uniform oval cross section space between the flanges which is comformable to an oval valve head. A metal post extending perpendicularly upward from the base plate has a round base cross section and a square upper end cross section which is engagable by a standard socket wrench. Opposed parallel tabs extend upwards from either side of the base plate. Both tabs contain holes coaxial with a line extending horizontally above the base plate through the center of the lower rounded portion of the post. A metal bar having in one end a groove conformable to the rounded portion of the base is adapted to insertion through either tab hole until the groove abuts the rounded base. Thus additional torque may be applied to the axis of the wrench and thence onto a valve handle by applying lateral force perpendicular to the free end of the bar.

OBJECTS OF THE INVENTION

One object of the present invention is to provide a wrench for turning oval valve handles without damages or marring the valve handle.

Another object of the invention is to provide a wrench which may be operated by applying torque about the axis of the wrench, or by a lateral force in a plane perpendicular to the axis of the wrench.

Another object of the invention is to provide a wrench which may be torqued by lateral force applied on either side of the wrench axis.

It is to be understood that although the invention disclosed herein is fully capable of achieving the objects stated and providing the advantages mentioned, the structural and operational characteristics of the invention described herein are merely illustrative of the preferred embodiments. Accordingly, I do not intend the scope of my exclusive rights and privilege in the invention to be limited to the details of construction described, but only to those embodiments and their reasonable equivalents and adaptations delineated in the appended claims.

BRIEF DESCRIPTION OF THE DRAWINGS

FIG. 1 is a top perspective view of the invention.

FIG. 2 is a bottom plan view of the device of FIG. 1.

FIG. 3 is top plan view of the device of FIG. 1.

DETAILED DESCRIPTION OF THE INVENTION

Figure 4:
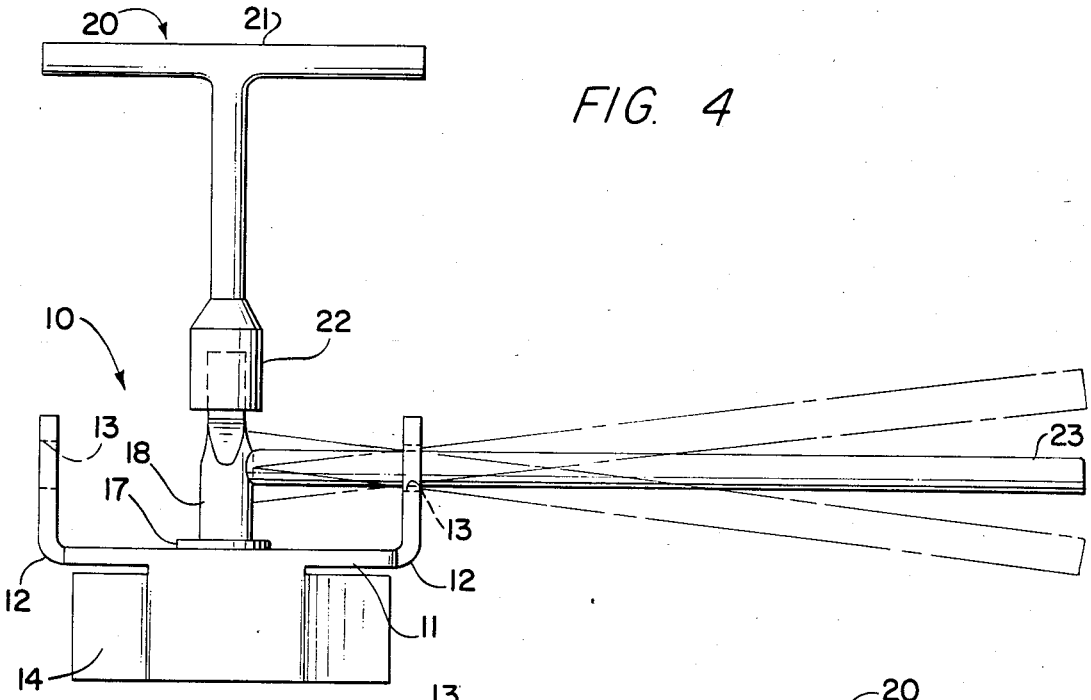
FIG. 4 is a side elevation view of the device of FIG. 1.

Referring to FIGS. 1, 2, 3 and 4, a wrench 10 is shown having a flat essentially rectangular base plate 11. The base plate is fabricated from a strong, rigid material, preferably sheet steel having a thickness of approximately 3/32" to $\frac{1}{8}$". Parallel flanges or tabs 12 fabricated of the same or similar material as the base plate extend perpendicularly upward from either lateral side of the longer transverse dimension of the rectangular base plate 11. Holes 13 are drilled through each tab 12. The center line of both holes 13 is a horizontal line parallel to base plate 11 and lying in the vertical midplane that transversely bisects the base plate into front and rear halves.

Extending perpendicularly downward from the front and rear edges of base plate 11 are flanges 14, which are fabricated from the same or similar material as base plate 1. Flanges 14 extend laterally for nearly the full width of base plate 11, and are joined to the base plate over a lateral distance equal to about one half the lateral width of the base plate. The joint between flanges 14 and base plate 11 extends equal lateral distances to either side of the vertical midplane that longitudinally bisects the base plate into left and right halves. The outer, free ends of flanges 14 are bent inward towards the transverse vertical midplane of base plate 11, thus forming an oval shaped box or cavity. The shape and size of the cavity are adapted to permit the box to fit conformably over a standard oval valve head.

As may be seen best by referring to FIG. 3, the smaller dimension sides of the box are open, resulting in a truncated oval cavity shape permitting clearance for the ends of oval valve heads. This permits the box to fit valve heads over a small range of size variations, and also ensures that, in use, force is not applied to the narrower, weaker ends of the valve head.

In the preferred embodiment, base plate 11, tabs 12 and flanges 14 are fabricated from a continuous sheet of steel plate which has been cut to shape. After the plate has been cut, tabs 12 are bent upward at right angles from the side edges of base plate 11, and flanges 14 are bent downward from the front and rear edges of base plate 11. In the final bending portion of the fabrication process, the lateral free ends of flanges 14 are bent inward. In the preferred embodiment, this final bending operation is done over an oval mandrel to form a curvilinear cavity.

As may be seen best by referring to FIG. 2, rectangular strips 15 of resilient non-slip material are bonded conformally to the inner vertical sides of flanges 14. Strips 15 are preferably fabricated from sheets of elastomeric material containing imbedded and projecting hard particles such as silica. Such material is commonly applied to surfaces which are walked upon to provide a higher coefficient friction to shoe soles than afforded by the underlying surface.

As may be seen best by referring to FIG. 1, a vertical metal post 16 having a base flange 17 is fastened to base plate 11 of wrench 10. Preferably, post 16 is made of steel and fastened to base plate 11 by butt welding post flange 17 to base plate 11. As shown in FIG. 1, the lower portion 18 of post 16 has a circular cross section. The upper end 19 of post 16 has a square cross section approximately $\frac{1}{4}''$ on a side. Thus, the upper end 19 of post 16 is adapted for insertion into a standard $\frac{1}{4}''$ wrench socket.

Figure 5:
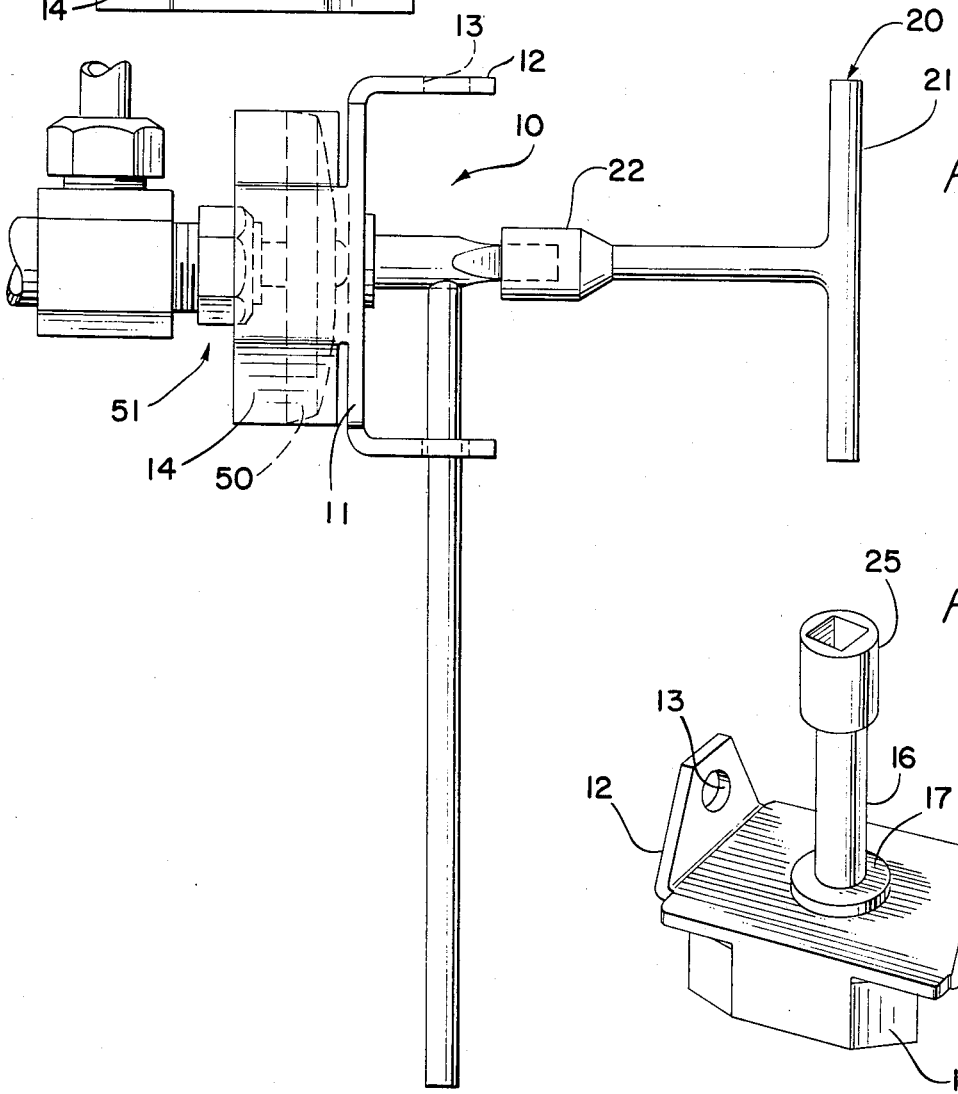
FIG. 5 is a side elevation view of the device of FIG. 1 showing how it is used to engage a valve handle.

A suitable socket wrench 20 for engaging post 16 comprises a T-shaped handle 21 and integral $\frac{1}{4}''$ wrench socket 22. Inserting upper end 19 of post 16 into socket 22 of wrench 20 permits torque applied to wrench 20 to be transmitted to post 16. FIG. 5 shows how wrench 10 is placed over handle 50 of a standard angle stop valve 51. FIG. 5 also illustrates how T-bar wrench 20 is used to engage post 16 of wrench 10.

Sometimes the placement of angle stop valve 51 provides little clearance between the top of valve handle 50 and nearby obstructions. For that reason the present invention incorporates alternate and additional means for applying torque to wrench 10. As shown in FIGS. 1 and 3, the alternate torquing means comprises a rigid bar 23, preferably made of steel, and having a grooved end 24 conformable to the circumference of circular cross section base 18 of post 16. To apply a torque to wrench 10 by use of bar 23, the bar is inserted through hole 13 in either tab 12. Bar 23 is then slid inwards towards post 16 until the grooved end 24 of bar 23 conformably engages the circumference of circular cross section base 18 of post 16. As may be seen best by referring to FIG. 4, secure contact between circular base 18 of post 16 and groove 24, which is of slightly large radius than base 18, may be effected without the requirement for a precisely parallel alignment between bar 23 and base plate 11. As indicated by dashed lines in FIG. 4, rod 23 may be displaced upwards or downwards from the position parallel with base plate 11 shown in solid lines, yet still securely engage post 16. Therefore, torque may be applied to wrench 10 through post 16 by applying a perpendicular force to the end of bar 23, even if the bar is inserted through hole 13 substantially askew from perpendicular alignment with post 16. Thus, as shown in FIG. 5, torque can be applied to angle stop valve handle 50 both by applying a torque around post 16 with socket wrench 20 and by applying a perpendicular force to the end of bar 23, whether or not bar 23 is precisely perpendicular to post 16. Of course, it is obvious that any standard wrench of the appropriate size for engaging the square cross section end 19 of post 16 may also be used to apply torque to post 16. Suitable standard wrenches include open-end, box-end, and ratcheting socket wrenches.

Figure 6:
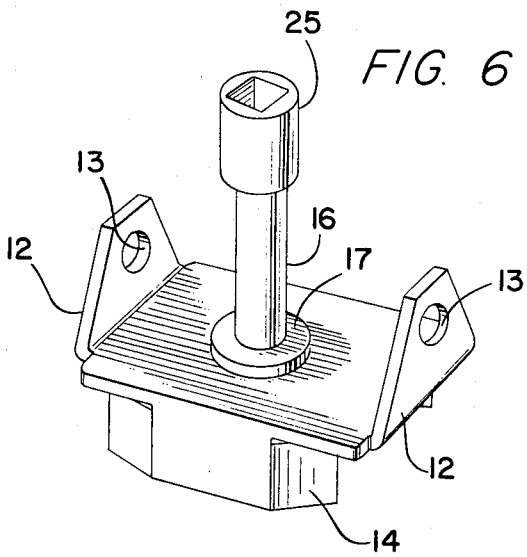
FIG. 6 is a top perspective view showing an alternate embodiment of the device of FIG. 1.

An alternate embodiment of the invention is shown in FIG. 6. As shown in the FIG. 1 the alternate embodiment differs from the embodiment shown in FIGS. 1 through 5 by having a square socket 25 rather than a square end 19 at the upper end of post 16. Socket 25 is engageable by a standard socket wrench drive handle, $\frac{1}{4}''$ as in the preferred embodiment.

What is claimed is:

1. A wrench for applying torque to the handles of valves of the type having a stem depending perpendicularly downward from the handle of said valve comprising:

a. a base plate having essentially flat and parallel upper and lower surfaces, b. a plurality of elongated flanges extending perpendicularly downward from said lower surface of said base plate, said flanges having essentially flat, vertically disposed inwardly facing surfaces describing an opening having a transverse cross-sectional shape at least partially conformable over the outer surface of said valve handle, c. an elongated cylindrical post extending perpendicularly upward from the center of said upper surface of said base plate, said post having a longitudinal center line disposed perpendicularly to said upper surface of said base plate, and said post having an upper end adapted to engagement by an external torquing member, d. at least one tab extending perpendicularly upward from said upper surface of said base plate, said tab having a hole coaxial with a line parallel to said base plate and intersecting said longitudinal center line of said post, whereby an elongated bar may be inserted through said hole and forced against said post, and e. means for maintaining said bar substantially within a plane perpendicular to said upper surface of said base plate, said plane containing both said longitudinal center line of said post and the bore axis of said hole in said tab, said means comprising a convex surface circular cross-section base portion of said post, and a concave surface circular cross-section groove of slightly larger radius in one end of said bar perpendicularly disposed to the longitudinal axis of said bar, said convex and concave surfaces being complementary and affording interlocking engagement between said bar and said post when said bar is inserted through said tab hole and forced against said post.

2. The device of claim 1 wherein said post is further defined as having a polygonal upper horizontal cross sectional shape adapted to locking engagement by external torque applying means.

3. The device of claim 2 wherein said post is further defined as having a square upper cross sectional shape adapted for insertion into a standard wrench socket.

4. The device of claim 3 further comprising in combination a T-bar socket wrench adapted to lockably receive the upper end of said post.

5. The device of claim 2 wherein said post is further defined as having a polygonal internal cross section socket rigidly fixed to the upper end of said post, said socket being adapted to lockable engagement by a socket wrench drive handle.

6. A wrench for applying torque to the handles of valves of the type having a stem depending perpendicularly downward from the handle of said valve comprising:

a. a base plate having essentially flat and parallel upper and lower surfaces, b. a plurality of elongated flanges extending perpendicularly downward from said lower surface of said base plate, said flanges having essentially flat, vertically disposed inwardly facing surfaces describing an opening having a transverse cross-sectional shape at least partially conformable over the outer surface of said valve handle, c. an elongated cylindrical post extending perpendicularly upward from the center of said upper surface of said base plate, said post having a longitudinal center line disposed perpendicularly to said upper surface of said base plate, a lower portion of said post having a circular external transverse cross-sectional shape, and an upper portion of said post having a polygonal transverse cross-sectional shape adapted to locking engagement by an external wrench, d. at least one pair of opposed vertically disposed tabs extending perpendicularly upward from opposite edges of said base plate, each said tab having a hole coaxial with a line parallel to said base plate and intersecting said longitudinal center line of said post, and e. an elongated cylindrical bar adapted to insertion through said hole in one of said tabs, at least one end of said bar having an arcuate cross-section groove complementary to said circular external transverse cross-section of the lower portion of said post, whereby said grooved end of said bar may be inserted through said hole in said tab and lockably engage said post.

7. The device of claim 6 wherein said inner facing surfaces of said flanges are further defined as having resilient surfaces.

8. The device of claim 7 wherein said resilient surfaces are further defined as comprising an elastomeric material bonded to the interior vertical sides of said flanges.

9. The device of claim 8 wherein said post is further defined as having a square upper cross sectional shape adapted for insertion into a standard wrench socket.

10. The device of claim 9 further comprising in combination a T-bar socket wrench adapted to lockably engage the upper end of said post.

11. The device of claim 8 wherein said post is further defined as having a polygonal internal cross section socket rigidly fixed to the upper end of said post, said socket being adapted to lockable engagement by a socket wrench drive handle.

* * * * *